US011833704B2

(12) United States Patent
Baker

(10) Patent No.: US 11,833,704 B2
(45) Date of Patent: Dec. 5, 2023

(54) DYNAMIC REGULATION OF CONTACT PRESSURES IN A BLADE SHARPENING SYSTEM

(71) Applicant: Lawrence E Baker, Clarkston, WA (US)

(72) Inventor: Lawrence E Baker, Clarkston, WA (US)

(73) Assignee: Fuzion LLC, Clarkston, WA (US)

( * ) Notice: Subject to any disclaimer, the term of this patent is extended or adjusted under 35 U.S.C. 154(b) by 0 days.

(21) Appl. No.: 17/991,798

(22) Filed: Nov. 21, 2022

(65) Prior Publication Data

US 2023/0226711 A1 Jul. 20, 2023

Related U.S. Application Data

(60) Division of application No. 17/502,025, filed on Oct. 14, 2021, now Pat. No. 11,504,873, which is a (Continued)

(51) Int. Cl.
*B24B 3/36* (2006.01)
*B24B 3/46* (2006.01)
(Continued)

(52) U.S. Cl.
CPC ..... *B26D 7/12* (2013.01); *B24B 3/363* (2013.01); *B24B 3/368* (2013.01); *B24B 3/46* (2013.01);
(Continued)

(58) Field of Classification Search
CPC ..... B24B 3/36; B24B 3/363; B24B 3/368; B24B 3/38; B24B 3/46; B24B 49/16; B24D 7/02; B24D 7/04; B24D 7/063; B24D 7/14; B24D 13/14; B24D 13/147; B26D 1/14; B26D 7/12; Y10T 83/303
(Continued)

(56) References Cited

U.S. PATENT DOCUMENTS 1,551,167 A * 8/1925 Orlow ..... B24B 3/56 83/788
2,766,566 A * 10/1956 Gage ..... B26D 7/12 451/422

(Continued)

*Primary Examiner* — Eileen P Morgan
(74) *Attorney, Agent, or Firm* — Farrell Patent Law PC; Mark Farrell

(57) ABSTRACT

Dynamic regulation of contact pressures in a blade sharpening system is provided. An example multiphase grinding wheel has a grinding face with one or more abrasive concentric rings for sharpening the cutting blade of the log saw machine, and one or more padded concentric rings consisting of fiber padding. Sharpening with the multiphase grinding wheel improves cut quality, increases blade life, removes glues and varnishes from the cutting blade, reduces blade deformation, and hones the edge of the cutting blade. A pneumatic tensioning system uses air bladders to apply dynamic cushioning and processor-controlled contact pressure between the grinding wheels and the cutting blade during sharpening. The fiber-padded grinding wheels and the air bladder tensioner provide improved sharpness of the cutting blade and longer life for the mechanical components.

10 Claims, 14 Drawing Sheets

Top View

Related U.S. Application Data continuation of application No. 17/009,764, filed on Sep. 1, 2020, now abandoned, which is a continuation of application No. 15/138,211, filed on Apr. 25, 2016, now Pat. No. 10,759,075, which is a continuation of application No. 14/274,561, filed on May 9, 2014, now Pat. No. 9,321,184.

(60) Provisional application No. 61/821,628, filed on May 9, 2013.

(51) Int. Cl.

| | |
|---|---|
| ***B26D 7/12*** | (2006.01) |
| ***B24B 49/16*** | (2006.01) |
| ***B24D 7/14*** | (2006.01) |
| ***B24D 13/14*** | (2006.01) |
| ***B26D 1/14*** | (2006.01) |
| ***B26D 3/16*** | (2006.01) |

(52) U.S. Cl.
CPC ..... *B24B 49/16* (2013.01); *B24D 7/14* (2013.01); *B24D 13/14* (2013.01); *B24D 13/147* (2013.01); *B26D 1/14* (2013.01); *B26D 3/16* (2013.01); *Y10T 83/303* (2015.04)

(58) Field of Classification Search
USPC ..... 451/45, 261, 262, 269, 293, 548, 550
See application file for complete search history.

(56) References Cited

U.S. PATENT DOCUMENTS 3,863,403 A * 2/1975 Fleming ..... B24B 3/42 451/421
4,173,846 A * 11/1979 Steiner ..... B23D 63/14 451/422
4,347,771 A * 9/1982 Bradley ..... B26D 7/12 83/174
5,090,281 A * 2/1992 Paulson ..... B26D 7/088 83/508.3
5,626,065 A * 5/1997 Cattini ..... B26D 7/12 451/295
6,224,468 B1 * 5/2001 Blume ..... B24B 3/463 451/48
6,368,189 B1 * 4/2002 Maloney ..... B24B 37/32 451/63
8,307,753 B2 * 11/2012 Woods ..... B63H 25/382 92/92
8,904,919 B2 * 12/2014 Woods ..... F15B 15/103 92/92
9,321,184 B2 * 4/2016 Baker ..... B26D 3/16
9,393,662 B2 * 7/2016 Schroeder ..... B24B 3/40
9,597,764 B2 * 3/2017 Barsotti Giovanni ... B26D 1/14
10,647,015 B2 * 5/2020 Mazzaccherini ..... B24B 3/46
10,759,075 B2 * 9/2020 Baker ..... B24B 3/46
2006/0000312 A1 * 1/2006 Chiocchetti ..... B26D 7/12 76/81.7
2006/0011015 A1 * 1/2006 Chiocchetti ..... B26D 7/12 76/81.7
2006/0162522 A1 * 7/2006 Chiocchetti ..... B26D 7/12 83/471
2012/0184186 A1 * 7/2012 Graham, Jr. ..... B23D 63/14 451/45
2013/0324014 A1 * 12/2013 Dovel ..... B24B 3/36 451/410
2021/0291317 A1 * 9/2021 Vasko ..... B24B 49/16

* cited by examiner

DYNAMIC REGULATION OF CONTACT PRESSURES IN A BLADE SHARPENING SYSTEM

RELATED APPLICATIONS

This divisional patent application claims the benefit of priority to U.S. patent application Ser. No. 17,502,025 to Baker, filed Oct. 14, 2021, now U.S. Pat. No. 11,504,873, which in turn claims priority to U.S. patent application Ser. No. 17/009,764 to Baker, filed Sep. 1, 2020, which in turn claims priority to U.S. patent application Ser. No. 15/138,211 to Baker, filed Apr. 25, 2016, now U.S. Pat. No. 10,759,075, which in turn claims priority to U.S. patent application Ser. No. 14/274,561 to Baker, filed May 9, 2014, now U.S. Pat. No. 9,321,184, which in turn claims the benefit of priority to U.S. Provisional Patent Application No. 61/821,628 to Baker, filed May 9, 2013, entitled, "Blade Sharpening System for Log Saw Machine," all of these references incorporated herein by reference in their entireties.

BACKGROUND

Log saw machines can be used to cut long rolls of paper products, such as paper towels and toilet paper into shorter rolls for marketing to consumers. As shown in FIG. 1, a conventional log saw machine consists of an orbital blade 100 capable of rotating through a log of paper ("paper log" or "log") to cut the log into consumer-size products, with two smaller grinding wheels 102 & 104 on either side of the orbital blade 100, which can contact an edge of the orbital blade 100 to automatically sharpen the orbital blade 100. The grinding wheels 102 & 104 sharpen the orbital blade 100 simultaneously, as the orbital blade 100 cuts the paper log. The grinding wheels 102 & 104 or "grinders" may be controlled by computer or by a programmable logic controller (PLC). A standard timing scenario for grinding is, for example, at every twenty cuts of the orbital blade, the grinding wheels 102 & 104 grind the edge of the orbital cutting blade 100 for four seconds. The cutting speed of the orbital blade 100 can be approximately 250 cuts per minute.

Conventional grinding wheels 102 & 104 used on tissue log saw machines employed a vitrified surface that causes the problems of sparking, loose grit, and a constant need for cleaning and adjustment. As the industry changes and the papers being cut become softer and lighter, the rolls of paper become more difficult to cut, and fires also become a problem.

Grinding wheels with cubic boron nitride (CBN) were introduced, generally in six inch or four inch diameters with a one-quarter inch face. The CBN grinding wheels sharpen better with less nicking and chipping than those with previously used abrasives. But due to conventional types of grinding systems, it is very difficult to design a bond between the grinding wheel and the CBN surface that breaks down properly under operational circumstances.

Besides the problem of designing a wheel that breaks down properly, there are three types of glue involved in the operation that affect the grinding wheels: transfer glue, the tail tie, and core glue. These glues load up on the face of the blade causing poor cut quality. Attempts to improve conventional grinding wheels have met little success. For example, using multiple types of CBN generally fails, as the various glues load up both types of CBN used. Lubricants were also introduced to help fight the glue problems, but provided little improvement. Costs to shut down and clean is a large cost to the industry in both production and safety. For example, the average cost of a production line can be around $1500.00 USD per hour. Moreover, there have been numerous accidents at all mills while operators cleaned the sharp blades and grinding wheels.

Conventionally, operators need to manually set the grinding wheels 102 & 104 to the orbital blade 100 for sharpening. This procedure is conventionally performed every 4-5 hours of production. Conventional metal pneumatic cylinders may be used to bring the grinding wheels 102 & 104 into the close vicinity of an orbital blade 100 for a sharpening cycle, and then used to remove or "pull back" the grinding wheels 102 & 104 after sharpening.

Air pressure is not conventionally used to tension the grinding wheels 102 & 104 against the orbital blade 100 during the sharpening itself. Conventionally, mechanical sharpening pressure, or tension, must be custom-set by hand and by human judgment. As shown in FIG. 2, the conventional tensioning is relatively fixed and rigid, and since the grinding rings 106 of conventional grinding wheels 102 & 104 are relatively narrow, the pressures between the grinding wheels 102 & 104 and the orbital blade 100 result in distortion, deformation, or deflection off a narrow point of the orbital blade 100 during sharpening (shown as exaggerated in FIG. 2).

Conventionally, if the stones, i.e., the grinding wheels 102 & 104 are not setup correctly then the orbital blade 100 becomes damaged and must be changed prematurely. Moreover, the setup of the grinding wheels 102 & 104 and adjustment is not a reliably safe procedure for human operators, as the exquisitely sharp orbital blade 100 and other potentially hazardous hardware are nearby at all times during the adjustment processes.

DETAILED DESCRIPTION

Overview

This disclosure describes dynamic regulation of contact pressures in a blade sharpening system, such as a blade sharpening system for log saw machines. The example blade sharpening system has multiple advantageous components and features. Example grinding wheels and an example tensioning system are described below.

Example Grinding Wheels

Figure 1:
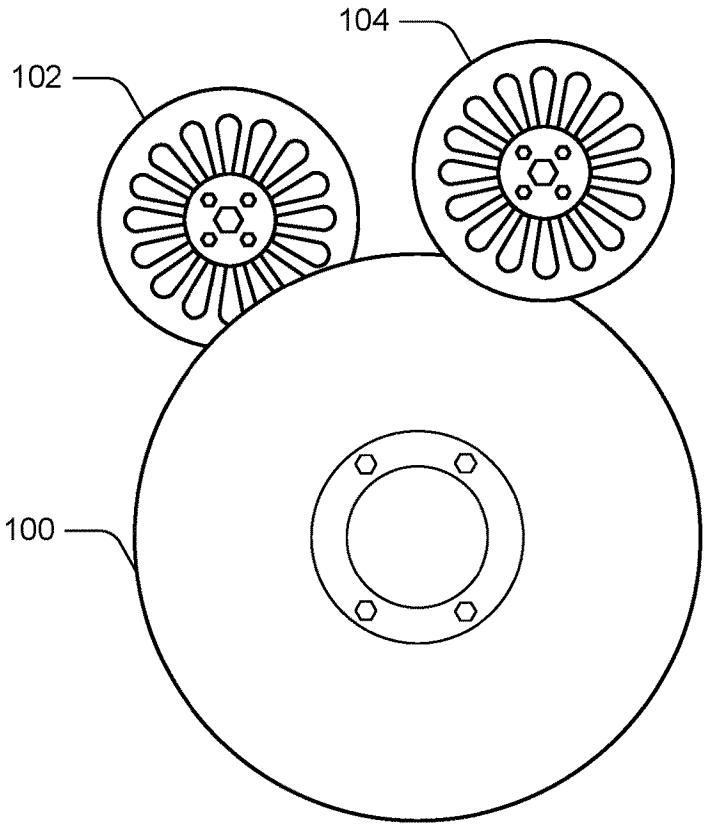
FIG. 1 (PRIOR ART)
FIG. 1 is a diagram of a conventional orbital cutting blade of a saw machine for cutting logs of rolled paper, with two grinding wheels positioned on either side of the orbital cutting blade.
Figure 2:
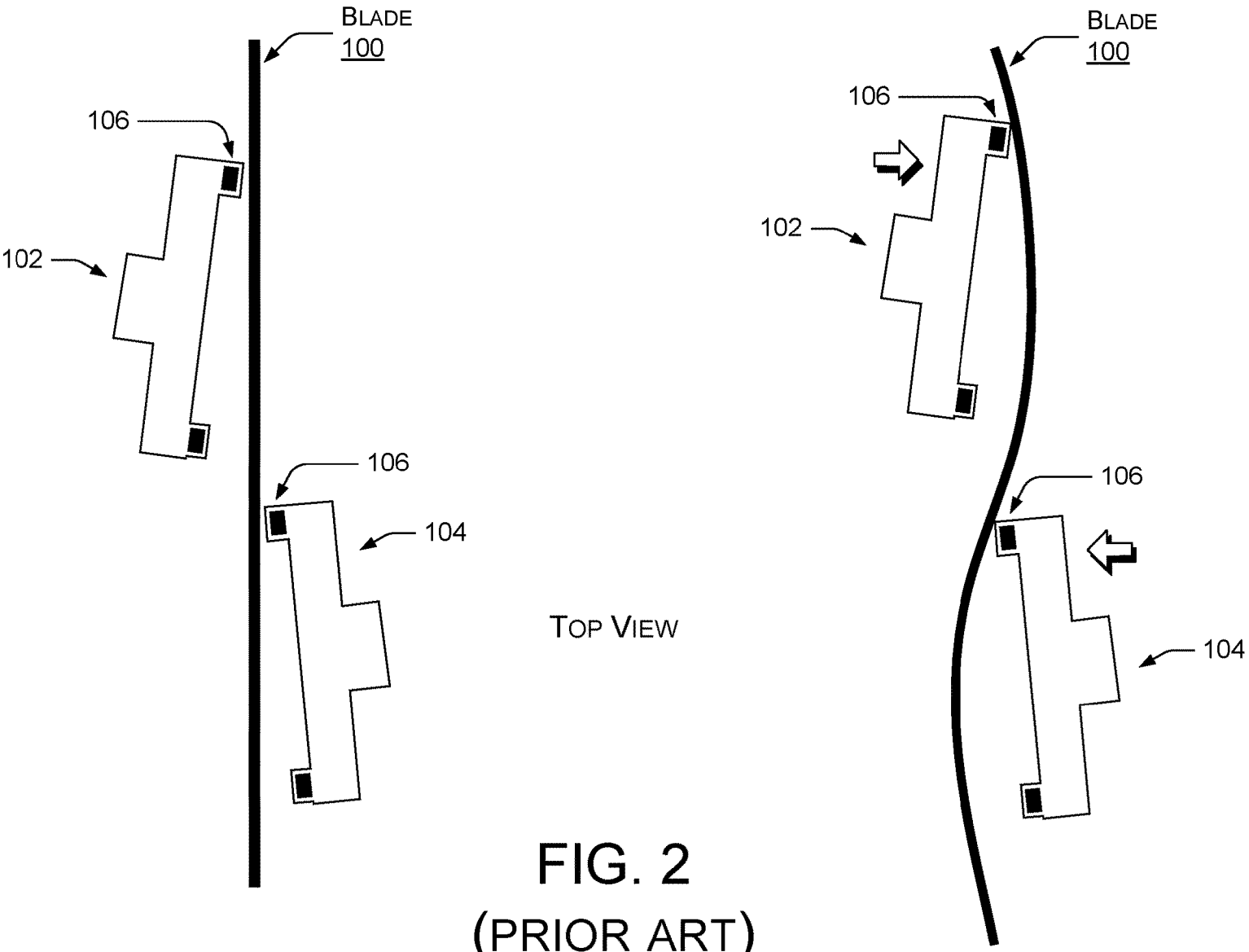
FIG. 2 (PRIOR ART)
FIG. 2 is a diagram of conventional blade distortion, deformation, and deflection using conventional grinding wheels for sharpening.
Figure 3:
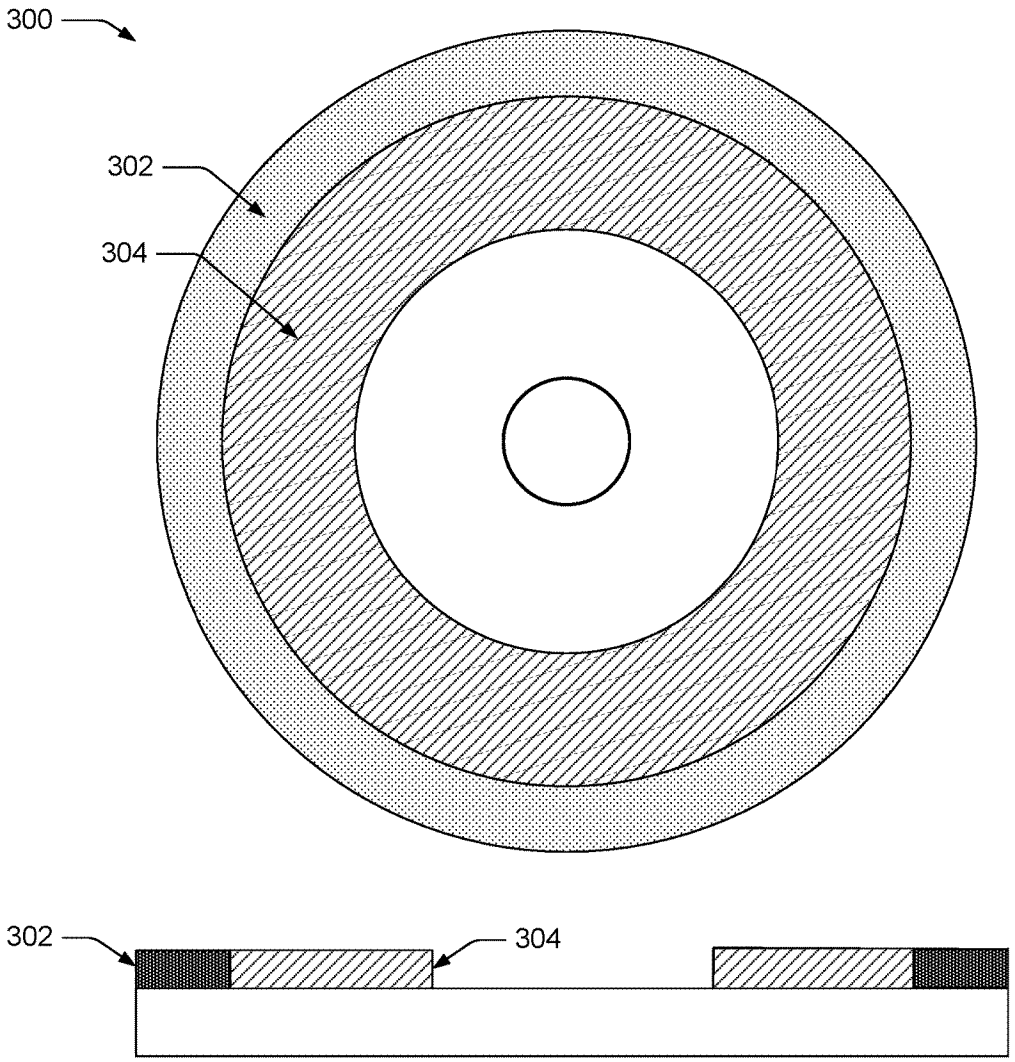
FIG. 3 is a diagram of an example multiphase grinding wheel having a concentric contact ring of abrasive grit and a concentric contact ring of fiber padding.

FIG. 3 shows an example multiphase grinding wheel 300. In an implementation, the multiphase grinding wheel 300 consists of a backing plate or pad, instead of the conventional rigid wheel in which only an outer race conventionally contacts the orbital blade 100 to be sharpened. The backing plate may be flexible, which provides some advantages, or may be rigid in other implementations.

In an implementation, the example multiphase grinding wheels 300 described herein each include a grinding face that has two or more concentric contact rings. For example, a first concentric contact ring 302 has a relatively hard grinding abrasive, such as particles or grit of cubic boron nitride (CBN), wurtzite boron nitride, silicon carbide, ceramic, or diamond (CBN will be used herein as an example to represent all hard abrasives), and is combined on the grinding face of the multiphase grinding wheel 300 with a second concentric contact ring 304 of a fiber pad. Such a two-phase contact surface can provide numerous advantages, such as:

- improved cut quality,
- a blade life increase of 25-100%,
- less sparking that reduces risk of fire,
- simplified setup of the grinding wheel to the orbital blade,
- a stabilized and cushioned interface between the face of the grinding wheel and the orbital blade,
- removal of glues and varnishes from the orbital blade,
- tempered aggressiveness of the more abrasive (e.g., CBN) concentric ring against the orbital blade,
- reduced distortion of the blade that eliminates blade squaring and scalloping, and
- polishing and honing of the edge of the orbital blade, with no burrs, into extreme sharpness.

The second concentric contact ring 304 made of a fiber pad or padding can be constructed of a solid-woven or nonwoven abrasive pad (e.g., as available from Norton or 3M) bonded to a flexible or non-flexible backing pad. The term "fiber abrasive pad" will be used representatively herein to designate the class of possible nonwoven and solid-woven fiber pads that can be used, including those with various degrees of abrasiveness ranging from almost zero to slightly aggressive. The second concentric contact ring 304 has less abrasive quality than the first concentric contact ring 302 that grinds the cutting edge during sharpening. However, the fiber abrasive pad of the second concentric contact ring 304 hones and polishes the sharp cutting edge created by the more aggressive first concentric contact ring 302. The fiber abrasive pad may have its own abrasive agents, such as a sparse fine powder of CBN impregnated in the fibers, or nano-, microscopic, or fine particles of another abrasive grit, but these are not as aggressively abrasive as those of the first concentric contact ring 302.

Figure 4:
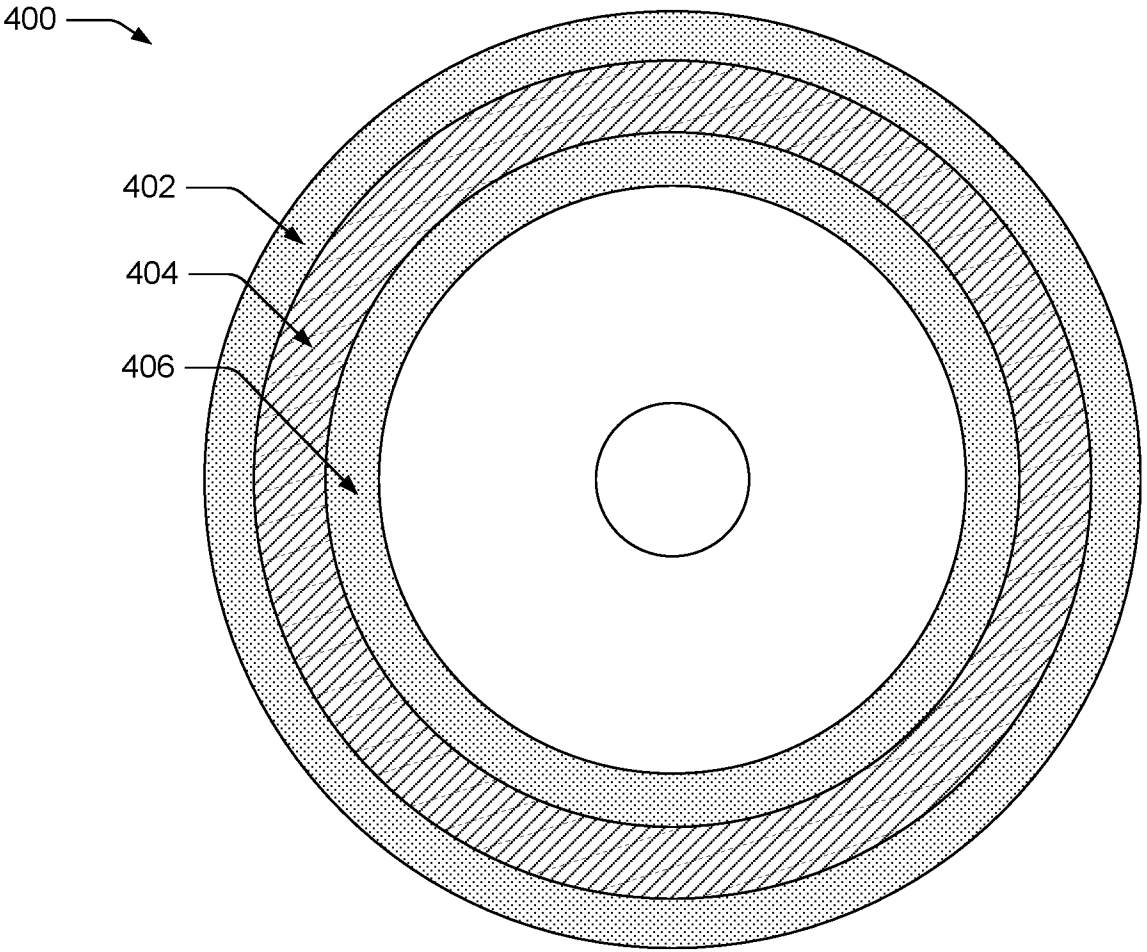
FIG. 4 is a diagram of an example multiphase grinding wheel that has more than two operative concentric contact rings, such as one or more concentric contact rings of abrasive grit and one or more concentric contact rings of fiber padding.

FIG. 4 shows another example multiphase grinding wheel 400 that has multiple concentric contact rings 402 & 404 & 406. A given multiphase grinding wheel, such as grinding wheel 400, may have one of more concentric rings of abrasive for grinding, and one or more concentric rings with nonwoven fiber pad. For example, a given grinding wheel 400 may have a first ring 402 and a third ring 406 that have a CBN abrasive, and a second ring 404 that is nonwoven fiber pad. Or, the example grinding wheel 400 may have a first ring 402 and a third ring 406 that are nonwoven fiber pad, while the second ring 404 has the CBN abrasive for grinding. Combinations of concentric rings that have abrasive for grinding or nonwoven fiber pad may be used.

Figure 5:
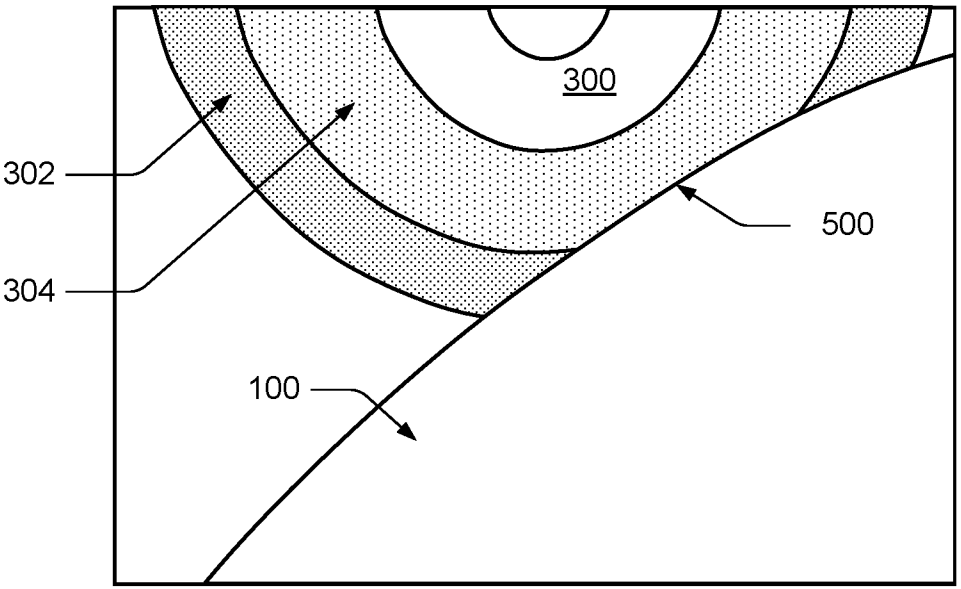
FIG. 5 is a diagram of an example multiphase grinding wheel in contact with the orbital cutting blade of a log saw machine.

FIG. 5 shows an example multiphase grinding wheel 300 in contact with the orbital blade 100 of the log saw machine for sharpening. The nonwoven fiber pad of the second concentric ring 304 on the grinding face provides a dynamic cushion between the grinding wheel 300 and the log saw blade 100 at the same time as the first concentric ring 302 grinds the cutting edge of the blade 100 to sharpness.

The second concentric ring 304 consisting of the nonwoven fiber pad is wide enough to spread the contact pressure between the grinding wheel 300 and the log saw blade 100 over a larger surface area than the contact surface area of the first concentric ring 302 would have if alone, and thereby reduces distortion and deformation of the blade 100 caused by the contact pressure. This improvement over conventional blade deformation also reduces squaring and scalloping of the blade 100.

The nonwoven fiber pad of the second concentric ring 304 can hone and polish the cutting edge of the log saw blade 100 as the same edge is being sharpened by the first concentric ring 302 of the grinding face that has the more aggressive abrasive for sharpening.

The nonwoven fiber pad of the second concentric ring 304 can also reduce sparking caused by the grinding and sharpening and reduces the risk of fire. In addition, the nonwoven fiber pad can buffer the tensioning adjustment between the grinding wheel 300 and the log saw blade 100 since the nonwoven fiber pad makes the contact surface broader and also changes the feel when the grinding wheel 300 and the blade 100 make contact. This slight difference in the contact between grinding wheel 300 and blade 100 can simplify setup of the grinding wheels 300 against the log saw blade 100.

The nonwoven fiber pad can also remove glues and varnishes picked up by the log saw blade 100 from the paper rolls being cut, even while the first concentric ring 302 of the grinding face is maintaining the bevel angle of the cutting edge of the log saw blade 100.

In an implementation, the backing plate of the grinding wheel 300 may also be made flexible to increase the flexibility of the pressure contact between the grinding wheel 300 and the log saw blade 100.

Figure 6:
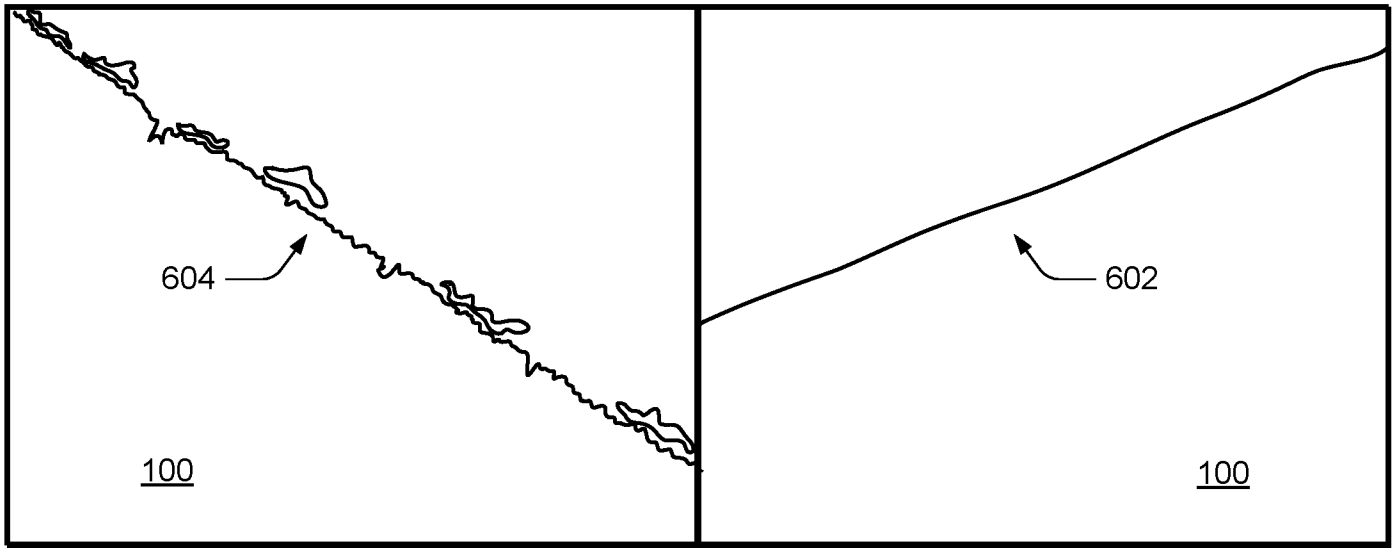
FIG. 6 is a diagram of a conventional sharpened edge of a log saw blade versus a sharpened edge of a log saw blade sharpened by an example multiphase grinding wheel.

In an implementation, the second concentric ring 304 of the grinding face and its fiber pad reduces and tempers the aggressiveness of the first concentric ring 302 in sharpening the cutting edge of the log saw blade 100. As shown in FIG. 6, the dynamically flexible pressure of the grinding wheel 300 on the log saw blade 100 combined with the honing and polishing action of the nonwoven fiber pad produces a sharper, cleaner edge 602 than a conventional sharpened edge 604, which has rough dips and burrs.

Figure 7:
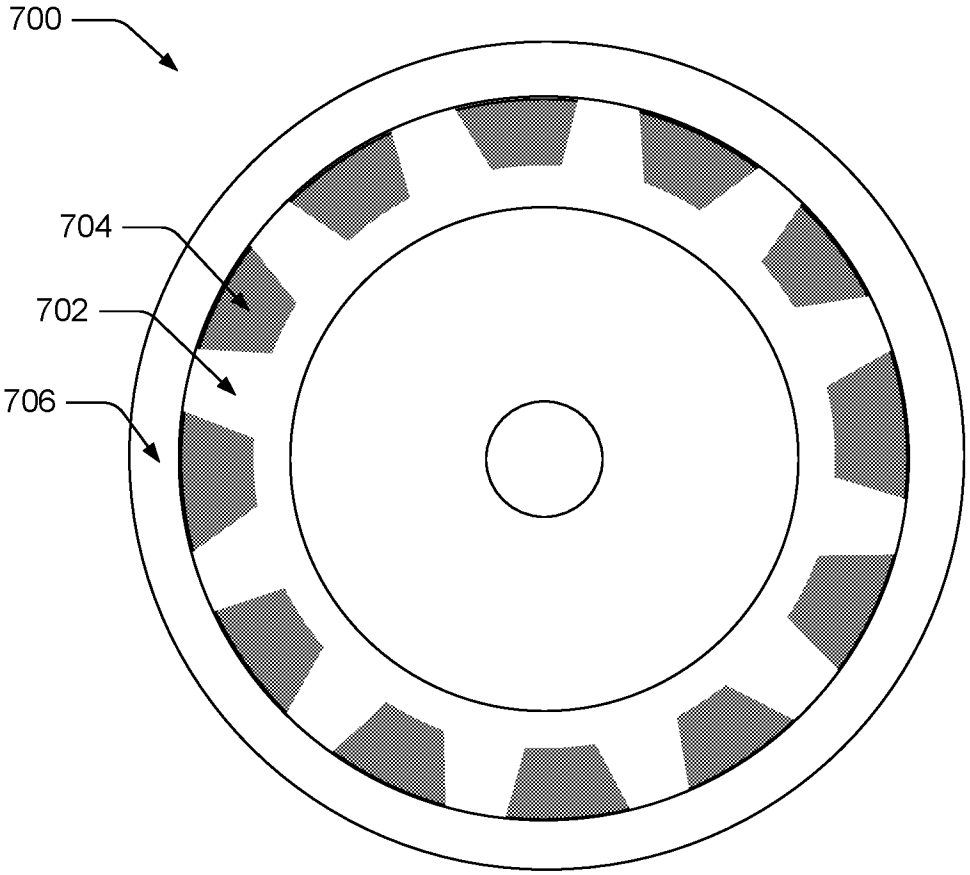
FIG. 7 is a diagram of an example segmented multiphase grinding wheel.

FIG. 7 shows an example segmented multiphase grinding wheel 700. In an implementation, the example multiphase grinding wheel 700 has a segmented contact surface in which abrasive segments 702 alternate with (e.g., nonwoven) fiber pad segments 704. In another implementation, each segment within a concentric ring may instead alternate with a neutral part of the wheel. The segments in a given segmented grinding wheel 700 may be either the abrasive surface or the nonwoven fiber pad surface. The example grinding wheel 700 may also include non-segmented concentric rings, such as concentric ring 706, used together on the same grinding face with the one or more segmented rings. The non-segmented concentric rings 706 may consist of either the abrasive or the nonwoven fiber pad.

Single and combination grinding wheels 300 may use variations in the width of the grinding face, and in the grit and bonding combinations. In an implementation, the fiber pad can be either a solid-woven or a nonwoven material. In an implementation, the fiber material is fixed to the backing plate, instead of being fixed to the conventional narrow race of a conventional grinding wheel 102 & 104. The backing plate itself may be one of numerous materials that can be flexible, non-flexible, solid, or slotted.

The abrasive for use on a concentric contact ring 302 can consist at least in part of CBN, diamond, or ceramic particles, for example, and can be bonded to a cloth material or to the backing plate by electroplating, coatings, resins, glues, fibers ceramics, vitrification, or other types of bonding. Thus, conventional or non-conventional grinding materials can be combined with cloth and the backing plate.

In an implementation, an example grinding wheel with a wider grinding face than conventional grinding wheels increases the surface area of contact with the cutting blade, the surface area of contact calculated to minimize deflection of the blade 100 off a narrow point.

In an implementation, a grinding wheel 300 with an increased coarseness of the grinding surface 302 allows longer run times, reducing glue buildup. The cut quality improves and persists for longer periods of time, and fire hazards are also reduced. A longer-running grinding wheel 300 also reduces human entry into the saw house or booth, improving safety and production.

In an implementation, the wider combined contact surfaces 302 & 304, as compared with conventional grinding wheels, allows coarser CBN or other abrasive to be bonded to the backing plate for more aggressive grinding and/or a longer grinding surface life. The backing plate can be metal, plastic, or a ferrous or non-ferrous material.

Example Tensioning System

For tensioning the multiphase grinding wheels 300 (or conventional grinding wheels) against the orbital cutting blade 100, an example air bladder system provides a dynamically correct sharpening tension between the grinding wheels 300 and the orbital blade 100 being sharpened.

Figure 8:
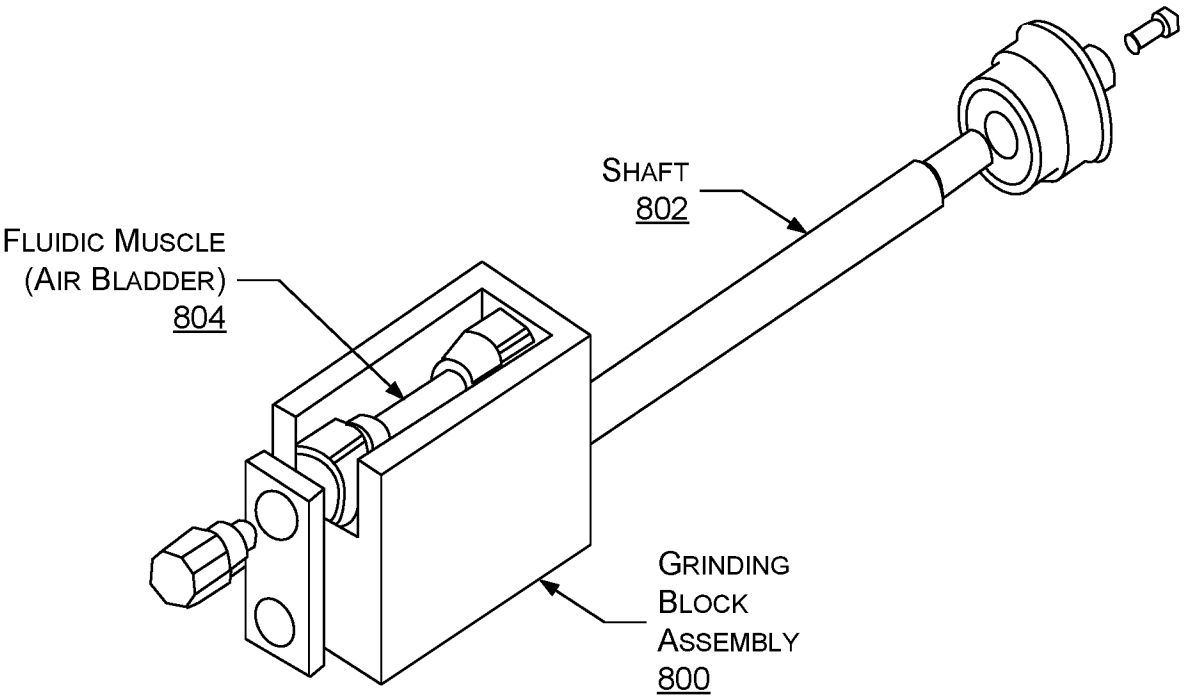
FIG. 8 is a diagram of an example grinding block assembly, including a fluidic muscle using an air bladder.

FIG. 8 shows an example grinding block assembly 800 that holds a grinding blade 300 (not shown in FIG. 8) on a shaft 802 against the orbital blade 100 (not shown in FIG. 8). Grinding block assemblies 800 of the air bladder tensioning system use a set of "fluidic muscles" 804 (with air bladders) that provide the pressure or tension between the grinding wheels 300 and the blade 100 during sharpening. The air bladders 804 afford some compressive spring, play, damping, elasticity, or flexibility in the pressure applied to hold the grinding wheels 300 against the blade 100 due to the elasticity and "give" of rubberized bladders 804 and also due to the ability of compressed air in the bladders 804 to provide a spring cushion. Conventionally, the pressure or tension between blade 100 and grinding wheel 102 is mechanically fixed and rigid, and has no "give," so that conventionally, any warp or variance in the flatness of the surfaces in contact with each other or any variance in the trueness of the axial spin of the blade 100 and grinding wheels 300 in their ideal planes results in unnecessary heat, friction, and aggressive wear of the surfaces.

With the example air bladder system using fluidic muscles 804, the sharpening tension can also be adjusted remotely, to remove human operators from the hazards of manual adjustments made around sharp and dangerous blade edges 100. In an implementation, the remote adjustment may even be automated. Further, when both improvements are used together, i.e., multiphase grinding wheels 300 used together with the fluidic muscle tensioners 804, superior blade sharpening is achieved and the longevity of both the orbital cutting blade 100 and the multiphase grinding wheels 300 is increased.

Figure 9:
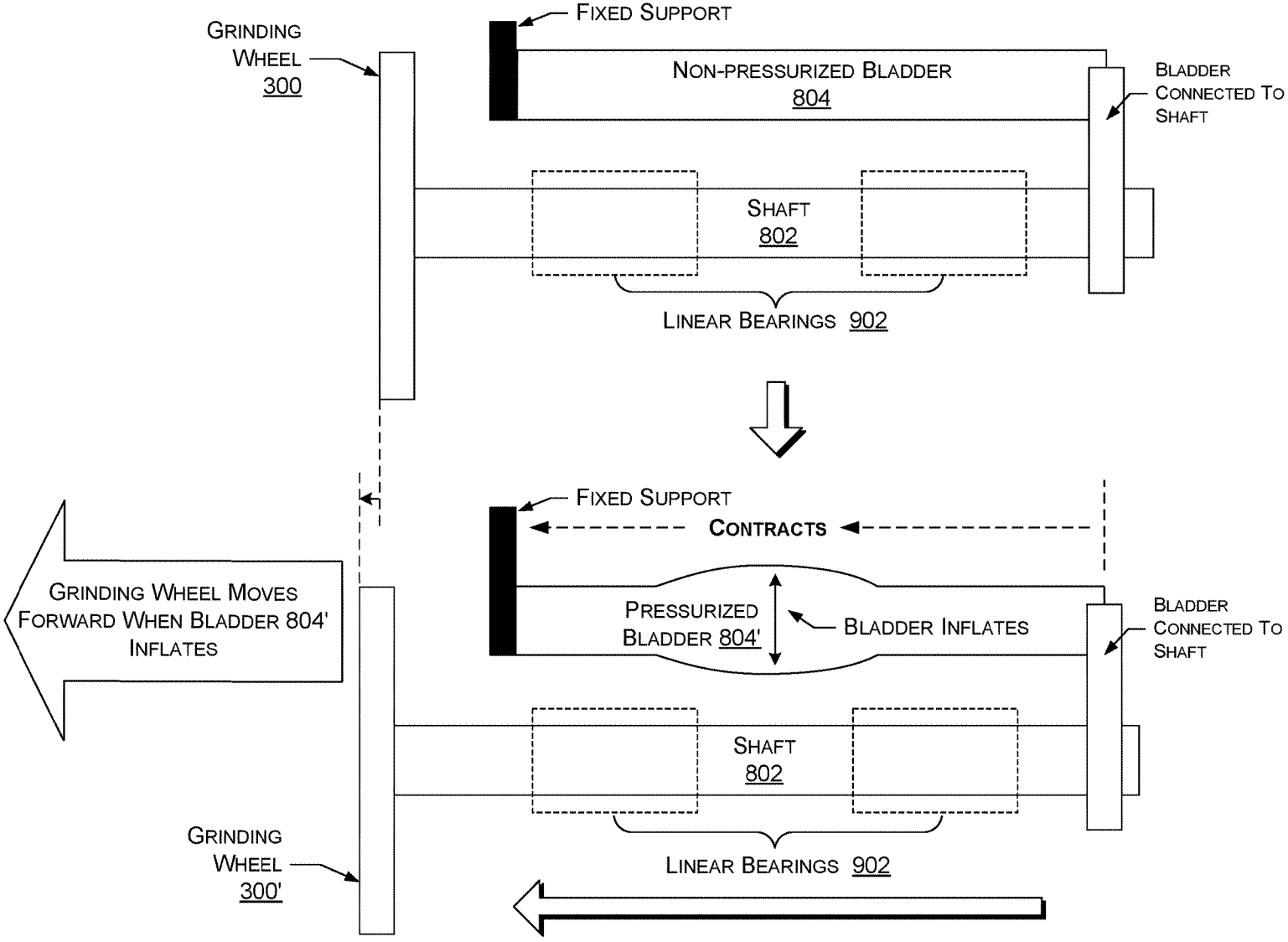
FIG. 9 is a diagram of example components and air bladder of the grinding block assembly.

FIG. 9 shows the grinding block assembly 800 of FIG. 8, in greater detail. The air bladder 804 of the fluidic muscle expands in a radial dimension when pneumatic pressure is applied, and the radial expansion causes the air bladder 804 to contract in the axial dimension. This contraction moves the shaft 802 within linear bearings 902 and is leveraged to push, or pull, the grinding face of respective grinding wheels 300, 300' on each side of the orbital cutting blade 100, into the edge being sharpened.

Figure 10:
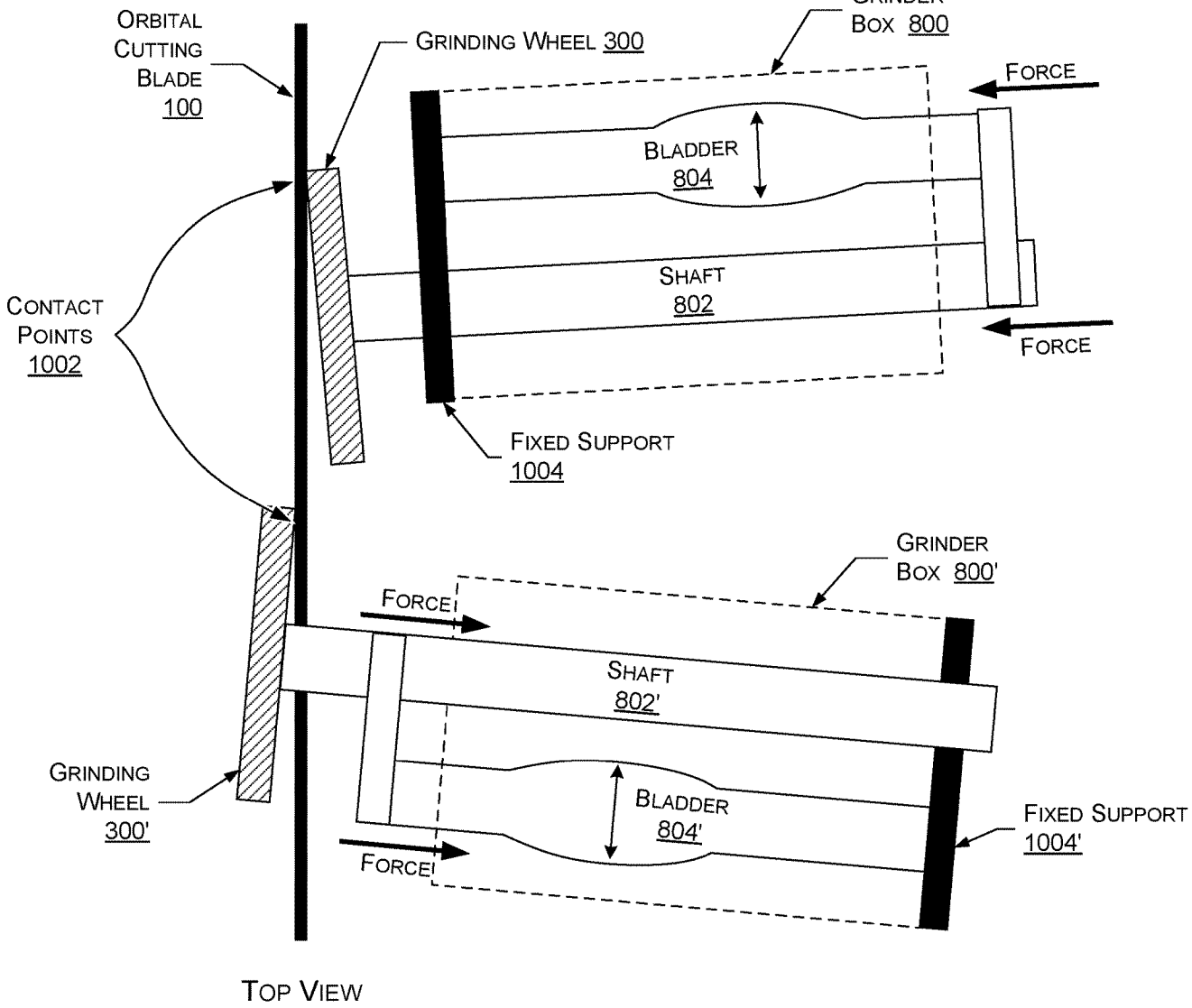
FIG. 10 is a diagram of example grinding block assemblies with grinding blades in contact on either side of an orbital cutting blade.

FIG. 10 shows two grinding block assemblies 800 and 800' (grinder box 800 and grinder box 800') rigged to hold tension on two grinding wheels 300 & 300' positioned on either side of the orbital cutting blade 100, with contact points 1002 on either side of the orbital blade 100. Depending on where the fixed support 1004 or 1004' is located in the configuration of the particular grinding block assembly 800 or 800', the pressurized air bladder 804 can either push (extend) the grinding wheel 300 into the blade 100 or pull (retract) the grinding wheel 300' into the far side of the blade 100.

The example system using air bladders 804 has some advantages. First, there are no rigidly mechanical parts to wear down as in a piston-style pneumatic cylinder. Second, the air bladder 804 and its air contents maintain some elasticity so that the grinding wheel 300 is not forced into the orbital blade 100 with an unyielding force that damages either the blade 100 or the grinding wheel 300 when maladjusted. Third, since the sharpening pressure being applied is more likely optimal, and self-adjusts in real-time because of the elasticity of the air bladder 804, all the interfacing parts last much longer.

Regulating Dynamic Tensioning Pressures

FIGS. 11-14 show an example pressure regulating system for regulating variations in applied contact pressure between the grinding wheels 300, 300' and the blade 100 being sharpened. The example pressure regulating system of FIGS. 11-14 adjusts (changes, varies, adapts) the contact pressure between each respective grinding wheel 300, 300' and the log saw blade 100 in real time, as the log saw blade 100 is being sharpened. Just as in FIGS. 3-10 the concentric rings 302, 304 and/or multiphasic segments 702, 704 and/or a backing plate or pad, and/or the fluidic muscle air bladders 804, 804' provide flexibility of the pressure contact between the grinding wheels 300, 300' and the log saw blade 100, the example pressure regulating system of FIGS. 11-14 continues this same theme by providing the ability to dynamically regulate the combined or separate contact pressures: between grinding wheel 300 and the log saw blade 100, and between grinding wheel 300' and the log saw blade 100.

As was shown and described with respect to FIG. 6 above, the dynamically flexible pressure of a given grinding (sharpening) wheel 300 on the log saw blade 100 combined with the honing and polishing action of the nonwoven fiber pad produces a sharper, cleaner edge 602 than a conventional sharpened edge 604, which has rough dips and burrs. Likewise, the example pressure regulating system of FIGS. 11-14 provides the ability to dynamically vary the contact pressures between grinding wheels 300, 300' and the log saw blade 100 at any given moment to achieve much better sharpening than is conventionally available, while greatly increasing the life of the log saw blade 100 and the grinding wheels 300, 300'.

In an implementation, the example system may include remote control that takes human operators out of the "saw house" or saw booth, the enclosure in which the sharp blades and potentially hazardous machinery reside. The remote control capability allows the operator to adjust the pneumatic sharpening tension from a safe distance. In an implementation, the adjustment of sharpening tension is handed over to computer control, or to a programmable logic controller (PLC).

In an implementation, the grinding wheels 300 & 300' are set a distance of 0.060 inch from the blade 100 before being brought into contact with the blade 100 by the fluidic muscles 804, 804' for sharpening.

Figure 11:
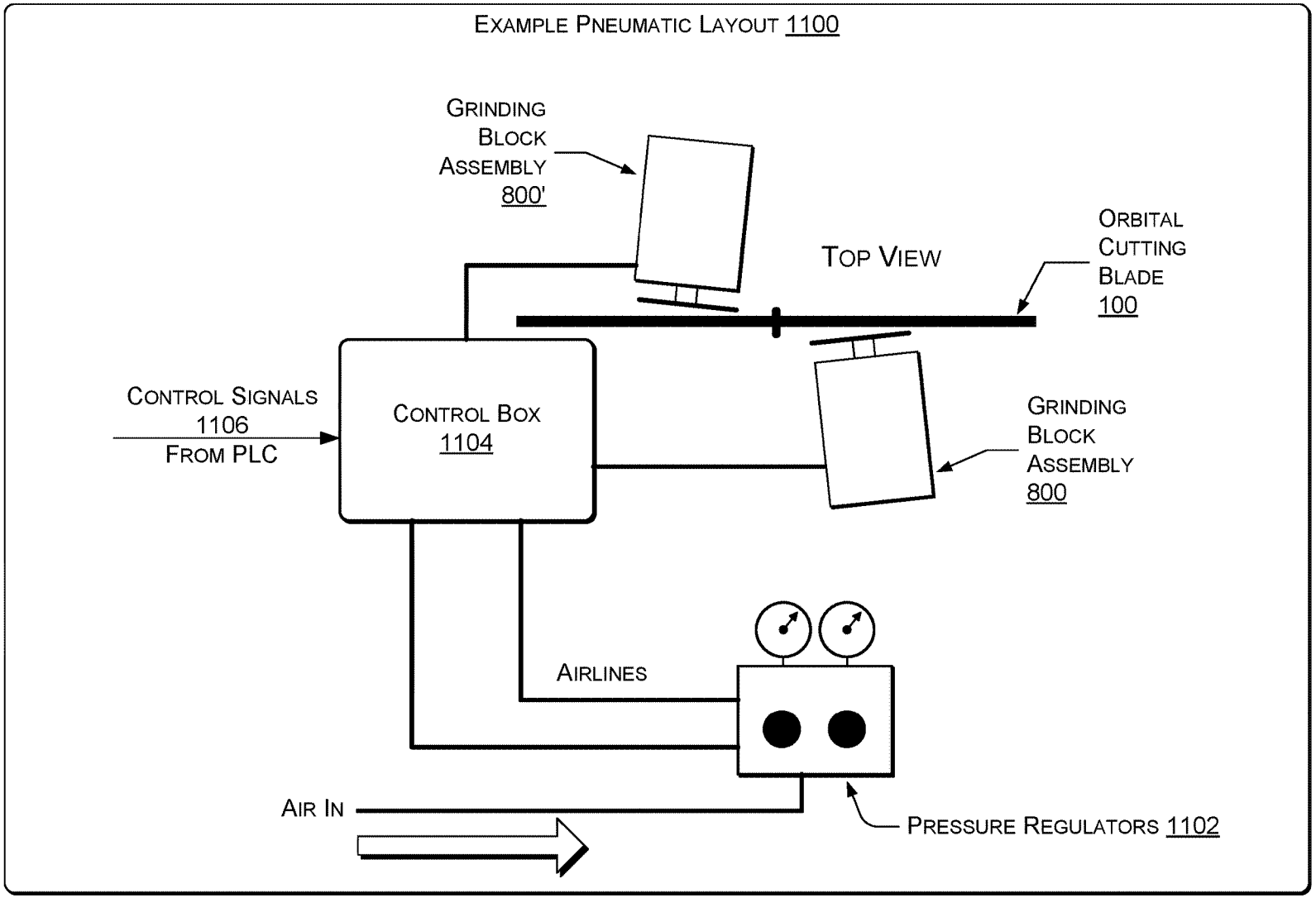
FIG. 11 is a diagram of an example pneumatic layout of the example blade sharpening system.

FIG. 11 shows an example pneumatic layout 1100 of the blade sharpening system. In FIG. 11, when ready to run, the sharpening tension applied to the grinding wheels 300 & 300' (the "stone pressure") is controlled by a set amount of air pressure from regulators, i.e., electronic pressure regulators 1102 & 1102', which may be remote from the location of the orbital cutting blade 100. A control box 1104 receives the regulated air pressure and controls the air provided to the fluidic muscle air bladders 804 & 804' based on control signals from a computer, control signals 1106 from a programmable logic controller (PLC), or manually from a human user. In an implementation, the air bladders 804 of each respective grinding block assembly 800, 800' pressurize and float, maintaining some air cushion or air spring because of their elasticity as they are never in the fully extended position when providing pressure.

The air bladders 804 actuate contact of the grinding wheels 300, 300' into the orbital blade 100 for grinding/sharpening. The control box 1104 not only controls the amount of air pressure provided to the fluidic muscle air bladders 804 & 804' based on control signals from a computer or programmable logic controller (PLC), but the electronic regulators 1102 & 1102' also control the amount of maximum pressure between a given grinding wheel 300 and the orbital log saw blade 100.

In an implementation, an adjustable shaft 802 with lock can set the grinding wheel 300 to a specific distance from the blade 100. These features allow the grinding wheels 300 & 300' to make contact at the same time with the blade 100. Then, the grinding wheels 300 & 300' float with any lateral motion of the blade 100 as the air bladders 804 & 804' apply the sharpening tension.

The control signals 1106 from the PLC can regulate the timing of contacts between the grinding wheels 300, 300' and the orbital blade 100. For example, the timing can be set to different timing schemes. In a first example timing mode, the operator sets a fixed length of grind time and sets a time interval between grinds. The control signals 1106 from the PLC regulate the pneumatic pressure of the fluidic muscles 804, 804' that advance the grinding wheels 300, 300' into the orbital blade 100, to account for a reduced diameter of the orbital blade 100 after grinding to sharpen. After a fixed number of grinds, also operator selectable, the PLC can calculate a new higher air pressure and sends the control signals 1106 to the control box 1104, pneumatically advancing the grinding wheels 300, 300' into each side of the orbital blade 100. The starting air pressure, amount of air pressure increase, and maximum output pressure are operator selectable parameters and/or can be dynamically managed by the PLC, for example.

In a second example timing mode, the PLC counts a number of saw cuts either from a proximity switch, sensor, or from the saw's control system. The computer or PLC then starts a grind cycle of the grinding wheels 300, 300' after a fixed number of cuts (operator selectable, or programmable) and each grind cycle can be a fixed length of time (also operator selectable, or programmable). The control signals 1106 from the PLC regulate the air pressure that advances the respective grinding wheels 300, 300' into the orbital blade 100. The operator or the programming can set a number of saw cuts that trigger a grind cycle, and also the mode of the air pressure increases and the actual pressures of the air pressure increases. The PLC can count a number of saw cuts and incrementally raise the pneumatic pressure to advance the grinding wheels 300, 300' each time that number of cuts is reached.

Figure 12:
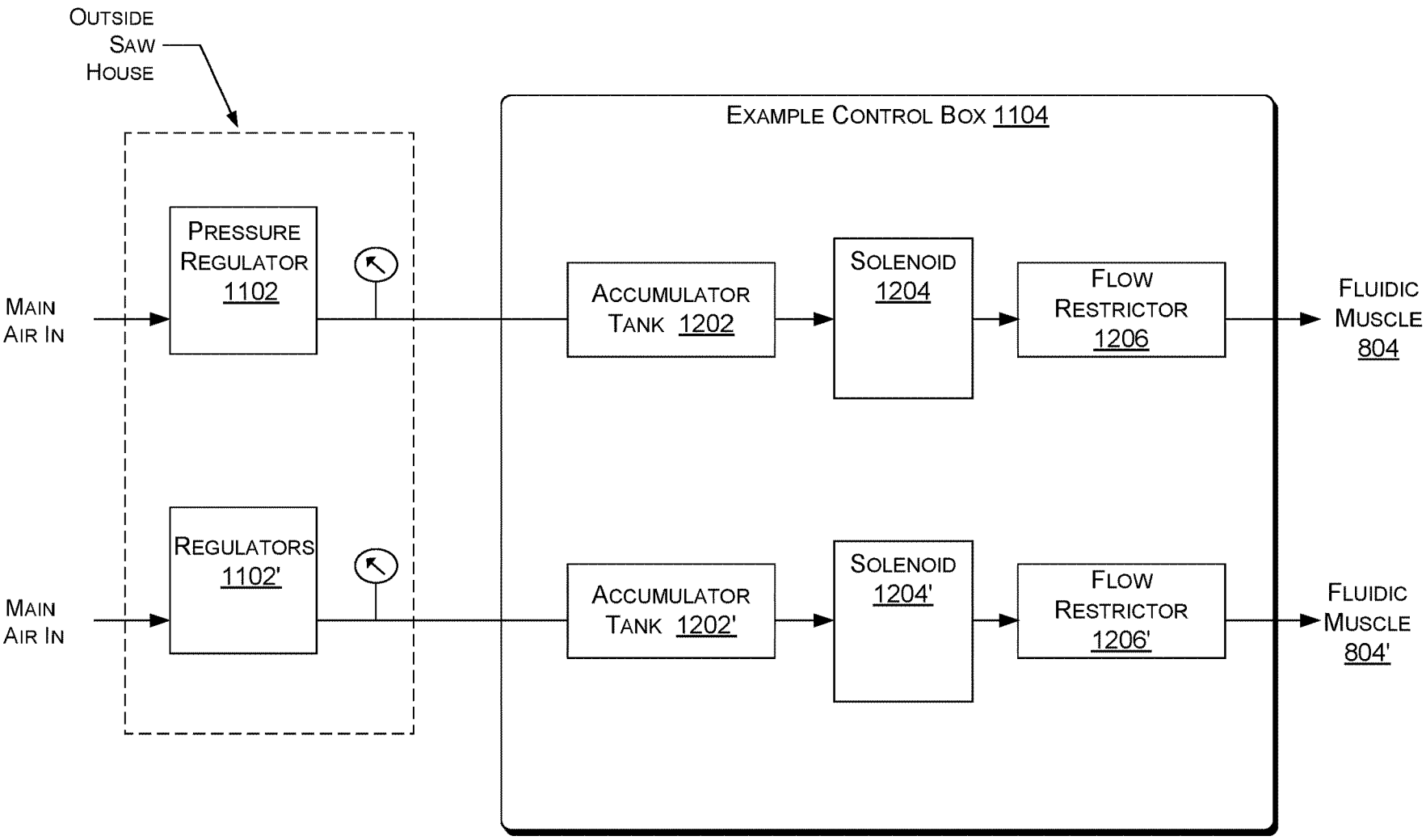
FIG. 12 is a block diagram of an example control box of the example blade sharpening system.

FIG. 12 shows an example of the control box 1104 of FIG. 11 in greater detail. The control box 1104 is a collection of components that may reside in a given room, area, or container. In an implementation, the electronic pressure regulators 1102, 1102' may reside outside the saw house or booth, but in some implementations the electronic pressure regulators 1102, 1102' can be in the control box 1104. Each air line from an electronic pressure regulator 1102 & 1102' is connected to a respective accumulator tank 1202, 1202' in the control box 1104 to provide an air supply for each fluidic muscle 804, 804'. The air supply(ies) continue in pneumatic circuit or pneumatic line to respective solenoids 1204 and 1204', which are under control of the PLC, or computer (or human operator). Respective flow restrictors 1206 & 1206' are valves, for example, that can apply final flow control into the respective air bladders of the fluidic muscles 804 & 804'. The control box 1104 of FIG. 11 provides an example implementation of pneumatic regulator control of the grinding wheels 300, 300' against the orbital blade 100. The air pressure regulation of the respective fluidic muscles 804, 804' and in turn, the grinding wheels 300, 300' against the orbital blade 100 may be accomplished by the control signals 1106 from the PLC controlling either the electronic pressure regulators 1102, 1102', or the flow restrictors 1206, 1206', or both the electronic pressure regulators 1102, 1102' and the flow restrictors 1206, 1206' and other components that can control and regulate air pressure to the air bladders of the fluidic muscles 804, 804'.

In an implementation, an operator or a machine performs an example setup procedure consisting of 1) setting the "chord length" or the overlap of the grinding wheels 300, 300' to the orbital blade 100; 2) setting each grinding wheel 300, 300' approximately 0.060 inch away from the blade

100, for example; 3) starting rotation of the orbital blade 100 and actuating the grinding system and its pneumatic layout 1100; 4) increasing the air pressure until one grinding wheel 300 starts to spin lightly; 5) bringing in the second grinding wheel 300' until it starts to spin; 6) and adding, for example, another two PSI of air pressure to the sharpening tension of each grinding wheel, e.g., using a pressure indicator. This example technique has the advantage that the orbital blade 100 is rotating when adjusting the grinding wheels 300, 300'. This scenario eliminates frequent visits into the saw house to adjust the grinding wheel tension, and improves production up-time.

The orbital blade 100 being sharpened is not rigid, so the orbital blade 100 deflects slightly when the grinding wheels 300, 300' make contact with the orbital blade 100.

The plane of the grinding wheels 300, 300' can be set to 7.5 degrees apiece, for example, with respect to the plane of the orbital blade 100. This angle may change during the grinding process. When the angle changes, the bevel of the orbital blade 100 can constantly change due to the amount of grinding wheel pressure that is used, or can change as the orbital blade 100 wears.

In an example method of operation, controlling the electronic pressure regulators 1102, 1102' and/or the flow restrictors 1206, 1206' with control signals 1106 from the PLC or a computer can reduce the amount of deflection of the orbital blade 100 during grinding/sharpening, which maintains a more accurate bevel angle of the cutting edge of the orbital blade 100. The electronic pressure regulators 1102, 1102' and/or the flow restrictors 1206, 1206' carefully control the amount of pressure between each grinding wheel 300, 300' pressed to the orbital blade 100 by the respective pneumatic tensioners, consisting of the air bladders of the fluidic muscles 804, 804' as depicted in FIG. 10.

In an implementation, a slower, longer grind that eases the grinding wheels 300, 300' into the orbital blade 100 and then slowly increases pressure between the grinding wheels 300, 300' and the orbital blade 100, and then slowly decreasing the pressure allows the grinding wheels 300, 300' to grind the cutting edge of the orbital blade from the tip down while maintaining the same bevel angle. In other words, increasing the respective pressures between the grinding wheels 300, 300' and the orbital blade 100 in a slow wave of increasing pressure, allows time for the grinding wheels 300, 300' to remove material from the blunted edge of the dull orbital blade 100 without forcing deflection of the orbital blade 100, resulting in a change in the bevel angle of the cutting edge. Likewise, decreasing the pressure between the grinding wheels 300, 300' and the orbital blade 100 in a slow wave of decreasing pressure allows the grinding wheels 300, 300' time to hone the cutting edge finely without forcing a deformation of the bevel angle as would happen if the orbital blade 100 was deflected by too much pressure from the grinding wheels 300, 300', or the grinding wheels 300, 300' were withdrawn too quickly.

The PLC or a processor (e.g., 1402 in FIG. 14) may be programmed with parameters or a "recipe" for control of the electronic regulators 1102, 1102' and/or flow restrictors 1206, 1206' to implement an exact, selectable mode of grinding/sharpening. In a "wave" mode of sharpening, for example, in which the pressure slowly increases and then slowly decreases, as described just above, example initial settings may be 30 PSI of air pressure=travel (of the grinding wheel 300) of approximately 0.030 inches=1.8 lbs of pressure between the grinding wheel 300 and the orbital blade 100, for example. 35 PSI of air pressure=travel of approximately 0.041 inches=2.0 lbs of pressure between a grinding wheel 300 and the orbital blade 100, for example. 40 PSI of air pressure=travel of approximately 0.052 inches=2.2 lbs of pressure between a grinding wheel 300 and the orbital blade 100, for example. 5 PSI of air pressure=travel of approximately 0.011 inches=0.2 lbs of pressure between a grinding wheel 300 and the orbital blade 100, for example.

In an example setup, approximately 0.007 inches travel=approximately 0.005 inches of deflection of the orbital blade 100. The wave recipe or programming of the PLC or processor 1402 may send control signals 1106 to provide 30 PSI and a travel distance of approximately 0.030 inches to contact the orbital blade 100 and apply 1.8 lbs of pressure between the grinding wheel 300 and the orbital blade 100, for example, easing the respective grinding wheels 300, 300' into the orbital blade 100. The PLC control signals 1106 inform the electronic pressure regulators 1102, 1102' to slowly increase the air pressure to 33 PSI, for example, over a time interval, and then slowly decrease the air pressure back to 30 PSI.

An example system may possess an orbital blade to be sharpened, for sawing logs of paper or rolls of paper, a grinding wheel for sharpening the orbital blade, and a pneumatic tensioner coupled to the grinding wheel. An air pressure regulator or a flow restrictor is in communication with the pneumatic tensioner for regulating a varying contact pressure between the grinding wheel and the orbital blade during the sharpening. A processor or a programmable logic controller sends control signals to the air pressure regulator or the flow restrictor to regulate the varying contact pressure between the grinding wheel and the orbital blade during the sharpening. The regulated varying contact pressure grinds the cutting edge of the orbital blade from the tip down while maintaining a same bevel angle, and/or continually reduces a deflection of the orbital blade as the sharpening progresses.

The example system may further include a fluidic muscle or an air bladder of the pneumatic tensioner. The processor or the programmable logic controller sends the control signals to the air pressure regulator or to the flow restrictor to regulate the fluidic muscle or the air bladder of the pneumatic tensioner. The fluidic muscle or the air bladder floats the grinding wheel against the orbital blade at a varying contact pressure that accommodates variations in the orbital blade.

The processor or the programmable logic controller may send the control signals to the air pressure regulator or to the flow restrictor in communication with the pneumatic tensioner to vary the contact pressure between the grinding wheel and the orbital blade in a sine wave pattern of slow increasing contact pressures and slow decreasing contact pressures applied between the grinding wheel and the orbital blade. Or, the processor or the programmable logic controller may send the control signals to the air pressure regulator or to the flow restrictor in communication with the pneumatic tensioner to vary the contact pressure between the grinding wheel and the orbital blade in a square wave pattern of contact pressures applied between the grinding wheel and the orbital blade.

In an implementation, a sensor or proximity switch counts revolutions or saw cuts of the orbital blade. The processor or the programmable logic controller sends the control signals to the air pressure regulator or to the flow restrictor in communication with the pneumatic tensioner to apply an intermittent contact pressure between the grinding wheel and the orbital blade to be sharpened based on the count. The control signals may determine sharpening intervals during application of the intermittent contact pressure, each sharpening interval consisting of a first number of revolutions of the orbital blade based on the counted revolutions or saw cuts. The control signals may also determine non-sharpening intervals during application of the intermittent contact pressure. Each non-sharpening interval may be a second number of revolutions of the orbital blade interleaved with the sharpening intervals, based on the counted revolutions or saw cuts.

The programmable logic controller may send the control signals to the air pressure regulator or the flow restrictor in communication with the pneumatic tensioner to vary the contact pressure between the grinding wheel and the orbital blade in a sine wave pattern or a square wave pattern of the contact pressure applied between the grinding wheel and the orbital blade. The pneumatic tensioner may be a fluidic muscle or an air bladder that expands in a radial dimension when pneumatic pressure is applied via the control signals, causing the fluidic muscle or the air bladder to contract in an axial dimension. The contact pressure between the grinding wheel and the orbital blade to be sharpened may self-adjust in real-time because of an elasticity of the fluidic muscle or the air bladder and because of the regulated varying contact pressure.

The processor or the programmable logic controller may send the control signals to respective air pressure regulators or respective flow restrictors in communication with a first pneumatic tensioner on a first side of the orbital blade and a second pneumatic tensioner on a second side of the orbital blade, to vary respective contact pressures between first and second grinding wheels on opposing sides of the orbital blade, and the orbital blade. The processor or the programmable logic controller may send the control signals to the respective air pressure regulators or respective flow restrictors in communication with the first pneumatic tensioner on the first side of the orbital blade and the second pneumatic tensioner on the second side of the orbital blade in respective independent sine wave patterns of the contact pressure or respective independent square wave patterns of the contact pressure applied between the first and second grinding wheels on opposing sides of the orbital blade, and the orbital blade.

The processor or the programmable logic controller may send the control signals to the air pressure regulator or the flow restrictor in communication with the pneumatic tensioner to regulate both a timing and a varying contact pressure between the grinding wheel and the orbital blade to be sharpened.

The system may include programmable recipes for actuating the processor or the programmable logic controller to send control signals for regulating the timing and variations in the contact pressure to be applied between the grinding wheel and the orbital blade during the sharpening.

Example Method

Figure 13:
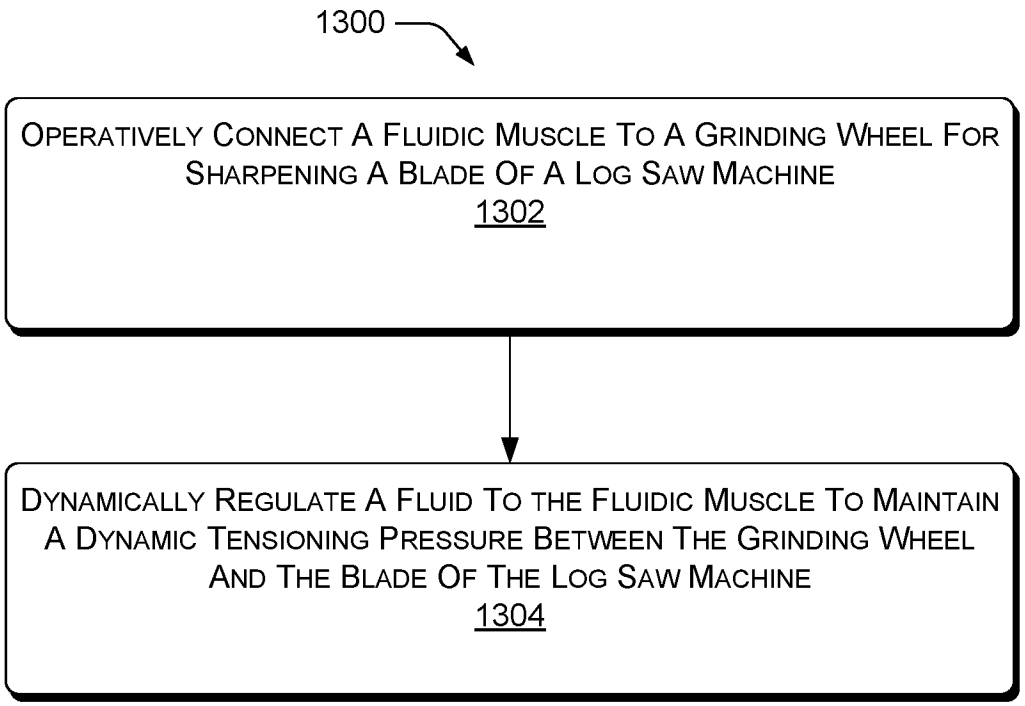
FIG. 13 is a flow diagram of an example method of improving blade sharpening of a log saw machine.

FIG. 13 shows an example basic method 1300 of improving blade sharpening of a log saw machine. The operations are shown in individual blocks.

At block 1302, a fluidic muscle is operatively connected to a grinding wheel for sharpening a blade of a log saw machine.

At block 1304, a fluid to the fluidic muscle is dynamically regulated to maintain an effective sharpening pressure between the grinding wheel and the blade of the log saw machine.

In an example method, a pneumatic tensioner is coupled to a grinding wheel. Control signals are sent from a programmable logic controller or a processor to an air pressure regulator or a flow restrictor in communication with the pneumatic tensioner for regulating a varying contact pressure between the grinding wheel and an orbital blade during a sharpening of the orbital blade. The regulated varying contact pressure enables grinding the cutting edge of the orbital blade from the tip down while maintaining a same bevel angle, and enables continually reducing a deflection of the orbital blade as the sharpening progresses.

The control signals may be sent to the air pressure regulator or the flow restrictor to regulate an air bladder or a fluidic muscle of the pneumatic tensioner. The air bladder or the fluidic muscle floats the grinding wheel against the orbital blade at a varying contact pressure that accommodates variations in the orbital blade.

The control signals may be sent to the air pressure regulator or the flow restrictor in communication with the pneumatic tensioner to vary the contact pressure between the grinding wheel and the orbital blade in a sine waveform pattern of the contact pressure applied between the grinding wheel and the orbital blade. Or, the control signals may be sent to the air pressure regulator or the flow restrictor in communication with the pneumatic tensioner to vary the contact pressure between the grinding wheel and the orbital blade in a square wave pattern of the contact pressure applied between the grinding wheel and the orbital blade.

In one implementation, revolutions or saw cuts of the orbital blade may be counted, and control signals sent to the air pressure regulator or the flow restrictor in communication with the pneumatic tensioner to apply an intermittent contact pressure between the grinding wheel and the orbital blade to be sharpened. The sharpening intervals during application of the intermittent contact pressure each comprise a first number of revolutions of the orbital blade based on the counted revolutions or saw cuts. Non-sharpening intervals during application of the intermittent contact pressure each comprise a second number of revolutions of the orbital blade interleaved with the sharpening intervals, based on the counted revolutions or saw cuts.

The control signals may be sent to the air pressure regulator or the flow restrictor in communication with the pneumatic tensioner to vary the contact pressure between the grinding wheel and the orbital blade in a sine wave pattern or a square wave pattern of the contact pressure applied between the grinding wheel and the orbital blade, in which the pneumatic tensioner is a fluidic muscle or an air bladder that expands in a radial dimension when pneumatic pressure is applied via the control signals, causing the fluidic muscle or the air bladder to contract in an axial dimension. The contact pressure between the grinding wheel and the orbital blade to be sharpened self-adjusts in real-time because of an elasticity of the fluidic muscle or the air bladder and the regulated varying contact pressure.

The control signals may be sent to respective air pressure regulators or respective flow restrictors in communication with a first pneumatic tensioner on a first side of the orbital blade and a second pneumatic tensioner on a second side of the orbital blade, to vary respective contact pressures between first and second grinding wheels on opposing sides of the orbital blade, and the orbital blade. The control signals may also be sent to the respective air pressure regulators or respective flow restrictors in communication with the first pneumatic tensioner on the first side of the orbital blade, and in communication with the second pneumatic tensioner on the second side of the orbital blade in respective independent sine wave patterns of the contact pressure or respective independent square wave patterns of the contact pressure applied between the first and second grinding wheels on opposing sides of the orbital blade, and the orbital blade.

The control signals from the programmable logic controller or the processor may be sent to the air pressure regulator or the flow restrictor in communication with the pneumatic tensioner for regulating both a timing and a varying contact pressure between the grinding wheel and the orbital blade being sharpened. The example method may include programming a recipe for the timing and variations in the contact pressure to be implemented by the programmable logic controller or the processor via the control signals for regulating both a timing and a varying contact pressure between the grinding wheel and the orbital blade being sharpened.

Example Control Environment

Figure 14:
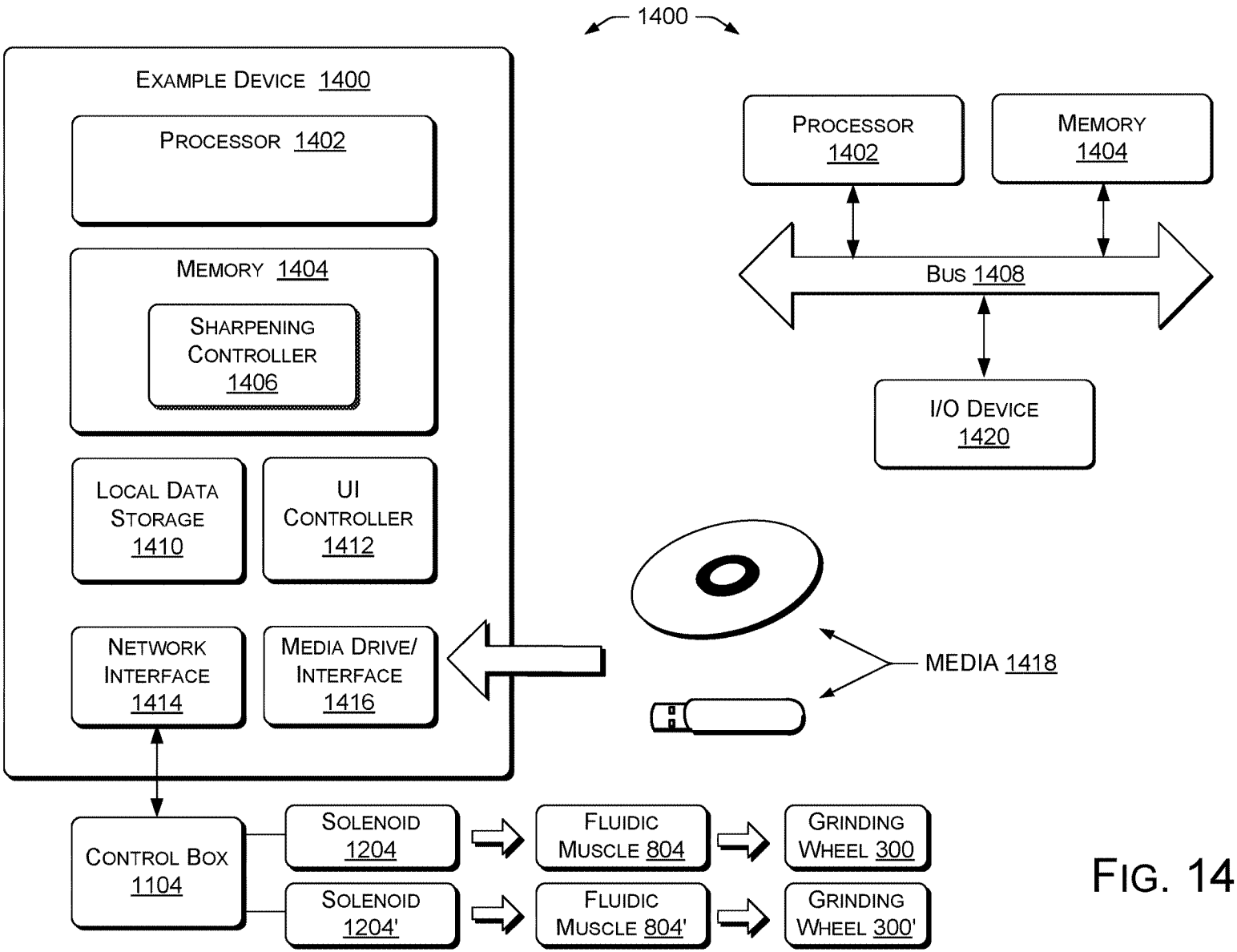
FIG. 14 is a block diagram of an example computing device or programmable logic controller (PLC) environment for blade sharpening control.

The example blade sharpening system uses a programmable logic controller (PLC) or other computing device for electronic control of pneumatic and mechanical components. FIG. 14 shows an example computing device 1400 to at least assist in controlling the example sharpening system. Example device 1400 has a processor 1402, and memory 1404 for hosting an example sharpening controller 1406. The shown example device 1400 is only one example of a computing device or programmable device, such as a PLC, and is not intended to suggest any limitation as to scope of use or functionality of the example device 1400 and/or its possible architectures. Neither should the example device 1400 be interpreted as having any dependency or requirement relating to one or to a combination of components illustrated in the example device 1400.

Example device 1400 includes one or more processors or processing units 1402, one or more memory components 1404, the sharpening controller 1406, a bus 1408 that allows the various components and devices to communicate with each other, and includes local data storage 1410, among other components.

Memory 1404 generally represents one or more volatile data storage media. Memory component 1404 can include volatile media, such as random access memory (RANI), and/or nonvolatile media, such as read only memory (ROM), flash memory, and so forth.

Bus 1408 represents one or more of any of several types of bus structures, including a memory bus or memory controller, a peripheral bus, an accelerated graphics port, and a processor or local bus using any of a variety of bus architectures. Bus 1408 can include wired and/or wireless buses.

Local data storage 1410 can include fixed media (e.g., RAM, ROM, a fixed hard drive, etc.) as well as removable media (e.g., a flash memory drive, a removable hard drive, optical disks, magnetic disks, and so forth).

A user interface device may also communicate via a user interface (UI) controller 1412, which may connect with the UI device either directly or through the bus 1408.

A network interface 1414 may communicate outside of the example device 1400 via a connected network, and in some implementations may communicate with hardware.

A media drive/interface 1416 accepts removable tangible media 1418, such as flash drives, optical disks, removable hard drives, software products, etc. Logic, computing instructions, or a software program comprising elements of the sharpening controller 1406 may reside on removable media 1418 readable by the media drive/interface 1416.

One or more input/output devices 1420 can allow a user to enter commands and information to example device 1400, and also allow information to be presented to the user and/or other components or devices. Examples of input devices 1420 include keyboard, a cursor control device (e.g., a mouse), a microphone, a scanner, and so forth. Examples of output devices include a display device (e.g., a monitor or projector), speakers, a printer, a network card, and so forth.

Various processes of the sharpening controller 1406 may be described herein in the general context of software or program modules, or the techniques and modules may be implemented in pure computing hardware. Software generally includes routines, programs, objects, components, data structures, and so forth that perform particular tasks or implement particular abstract data types. An implementation of these modules and techniques may be stored on or transmitted across some form of tangible computer readable media. Computer readable media can be any available data storage medium or media that is tangible and can be accessed by a computing device. Computer readable media may thus comprise computer storage media.

"Computer storage media" designates tangible media, and includes volatile and non-volatile, removable and non-removable tangible media implemented for storage of information such as computer readable instructions, data structures, program modules, or other data. Computer storage media include, but are not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other tangible medium which can be used to store the desired information, and which can be accessed by a computer.

Conclusion

Although only a few example embodiments have been described in detail above, those skilled in the art will readily appreciate that many modifications are possible in the example embodiments without materially departing from the subject matter. Accordingly, all such modifications are intended to be included within the scope of this disclosure as defined in the following claims.

The invention claimed is:

1. A system, comprising:

an orbital blade to be sharpened, the orbital blade for sawing logs of paper or rolls of paper;

a grinding wheel for sharpening the orbital blade;

a pneumatic tensioner coupled to the grinding wheel;

an air pressure regulator in communication with the pneumatic tensioner for regulating a varying contact pressure between the grinding wheel and the orbital blade during the sharpening;

a processor for sending control signals to the air pressure regulator for regulating the varying contact pressure between the grinding wheel and the orbital blade during the sharpening, the regulated varying contact pressure for grinding a cutting edge of the orbital blade at a bevel angle of the grinding wheel with respect to a plane of rotation of the orbital blade;

logic or executable instructions causing the processor to:

count revolutions or saw cuts of the orbital blade;

send the control signals to the air pressure regulator in communication with the pneumatic tensioner to apply the intermittent contact pressure between the grinding wheel and the orbital blade to be sharpened;

wherein sharpening intervals during application of the intermittent contact pressure each comprise a first number of revolutions of the orbital blade based on the counted revolutions or saw cuts; and wherein non-sharpening intervals during application of the intermittent contact pressure each comprise a second number of revolutions of the orbital blade interleaved with the sharpening intervals, based on the counted revolutions or saw cuts.

2. The system of claim 1, further comprising a fluidic muscle or an air bladder of the pneumatic tensioner; and wherein the processor sends the control signals to the air pressure regulator to regulate the fluidic muscle or the air bladder of the pneumatic tensioner, the fluidic muscle or the air bladder to float the grinding wheel against the orbital blade at a varying contact pressure that accommodates variations in the orbital blade.

3. The system of claim 1, wherein the processor sends the control signals to the air pressure regulator or to the flow restrictor in communication with the pneumatic tensioner to vary the contact pressure between the grinding wheel and the orbital blade in a sine wave pattern of slow increasing contact pressures and slow decreasing contact pressures applied between the grinding wheel and the orbital blade.

4. The system of claim 1, wherein the processor sends the control signals to the air pressure regulator or to the flow restrictor in communication with the pneumatic tensioner to vary the contact pressure between the grinding wheel and the orbital blade in a square wave pattern of contact pressures applied between the grinding wheel and the orbital blade.

5. The system of claim 1, further comprising a sensor or proximity switch for counting revolutions or saw cuts of the orbital blade;

wherein the processor sends the control signals to the air pressure regulator in communication with the pneumatic tensioner to apply an intermittent contact pressure between the grinding wheel and the orbital blade to be sharpened;

wherein the control signals determine sharpening intervals during application of the intermittent contact pressure, each sharpening interval comprising a first number of revolutions of the orbital blade based on the counted revolutions or saw cuts; and wherein the control signals determine non-sharpening intervals during application of the intermittent contact pressure, each non-sharpening interval comprising a second number of revolutions of the orbital blade interleaved with the sharpening intervals, based on the counted revolutions or saw cuts.

6. The system of claim 1, wherein the processor sends the control signals to the air pressure regulator in communication with the pneumatic tensioner to vary the contact pressure between the grinding wheel and the orbital blade in a sine wave pattern or a square wave pattern of the contact pressure applied between the grinding wheel and the orbital blade;

wherein the pneumatic tensioner comprises a fluidic muscle or an air bladder that expands in a radial dimension when pneumatic pressure is applied via the control signals, causing the fluidic muscle or the air bladder to contract in an axial dimension; and wherein the contact pressure between the grinding wheel and the orbital blade to be sharpened self-adjusts in real-time because of an elasticity of the fluidic muscle or the air bladder and the regulated varying contact pressure.

7. The system of claim 1, wherein the processor sends the control signals to respective air pressure regulators or respective flow restrictors in communication with a first pneumatic tensioner on a first side of the orbital blade and a second pneumatic tensioner on a second side of the orbital blade, to vary respective contact pressures between the orbital blade and first and second grinding wheels on opposing sides of the orbital blade.

8. The system of claim 7, wherein the processor sends the control signals to the respective air pressure regulators in communication with the first pneumatic tensioner on the first side of the orbital blade and the second pneumatic tensioner on the second side of the orbital blade in respective independent sine wave patterns of the contact pressure or respective independent square wave patterns of the contact pressure applied between the first and second grinding wheels on opposing sides of the orbital blade, and the orbital blade.

9. The system of claim 1, wherein the processor sends the control signals to the air pressure regulator or the flow restrictor in communication with the pneumatic tensioner for regulating both a varying contact pressure between the grinding wheel and the orbital blade to be sharpened and a timing of the varying contact pressure.

10. The system of claim 9, further comprising user-programmable logic or executable instructions causing the processor to programmatically vary the varying contact pressure and the timing of the varying contact pressure.

* * * * *